US010827852B2

(12) United States Patent
Zhao et al.

(10) Patent No.: US 10,827,852 B2
(45) Date of Patent: Nov. 10, 2020

(54) DUAL-CHAMBER PACKAGE SYSTEM FOR ABSORBENT ARTICLES

(71) Applicant: The Procter & Gamble Company, Cincinnati, OH (US)

(72) Inventors: Chao Zhao, Beijing (CN); Zhensheng Liu, Beijing (CN); Xuejiao Sun, Beijing (CN); Kaitian Wang, Beijing (CN); Lu Ji, Beijing (CN); Jayson Oxcena Gawaran, Beijing (CN); Minchen Du, Beijing (CN); Ankan Mandal, Mumbai (IN); Jie Chen, Beijing (CN); Mark Andrew Thornton, Beijing (CN)

(73) Assignee: The Procter & Gamble Company, Cincinnati, OH (US)

( * ) Notice: Subject to any disclaimer, the term of this patent is extended or adjusted under 35 U.S.C. 154(b) by 135 days.

(21) Appl. No.: 16/019,634

(22) Filed: Jun. 27, 2018

(65) Prior Publication Data

US 2019/0029442 A1 Jan. 31, 2019

Related U.S. Application Data

(63) Continuation of application No. PCT/CN2017/094429, filed on Jul. 26, 2017.

(51) Int. Cl.
*A47F 1/08* (2006.01)
*B65D 5/72* (2006.01)
(Continued)

(52) U.S. Cl.
CPC ..... *A47F 1/08* (2013.01); *B65D 5/16* (2013.01); *B65D 5/38* (2013.01); *B65D 5/542* (2013.01); *B65D 5/721* (2013.01); *B65D 5/724* (2013.01)

(58) Field of Classification Search
CPC .. A47F 1/08; B65D 5/16; B65D 5/724; B65D 5/726; B65D 5/72; B65D 5/721;
(Continued)

(56) References Cited

U.S. PATENT DOCUMENTS 1,694,897 A * 12/1928 Washburn ..... A47F 1/08 221/198
2,434,514 A * 1/1948 Penn ..... A24F 15/04 221/205
(Continued)

FOREIGN PATENT DOCUMENTS

CN 201354191 12/2009
CN 202807340 3/2013
(Continued)

OTHER PUBLICATIONS

International Search Report and Written Opinion, PCT/CN2017/094429.

*Primary Examiner* — Robert Poon
(74) *Attorney, Agent, or Firm* — Christian M. Best

(57) ABSTRACT

A dual-chamber package system for absorbent articles, comprises: a retaining chamber configured to vertically retain a plurality of absorbent articles, a dispensing chamber positioned underneath the retaining chamber, wherein the dispensing chamber has a front side opening, and a divider separating the retaining chamber and the dispensing chamber, wherein at least a portion of the divider is moveable so that a bottommost absorbent article is configured to be dispensed from the front side opening of the dispensing chamber.

19 Claims, 5 Drawing Sheets

(51) Int. Cl.
*B65D 5/16* (2006.01)
*B65D 5/38* (2006.01)
*B65D 5/54* (2006.01)

(58) Field of Classification Search
CPC ..... B65D 5/728; B65D 47/046; B65D 75/58; B65D 83/08; B65D 83/0005; B65D 83/0835; A47K 10/24
USPC ..... 206/738, 229, 233, 494
See application file for complete search history.

(56) References Cited

U.S. PATENT DOCUMENTS 2,627,972 A * 2/1953 Roos ..... A47F 1/10 206/731
3,002,651 A * 10/1961 Gauld ..... B65D 5/726 221/34
3,186,591 A * 6/1965 Solomon ..... B65D 5/724 221/260
3,747,802 A * 7/1973 Uroshevich ..... B65D 43/162 221/63
6,799,695 B1 * 10/2004 Borrero ..... A47K 10/427 206/467
8,136,697 B2 * 3/2012 Hackney ..... A47F 1/08 221/303
9,283,128 B2 3/2016 Ulrich
2011/0114660 A1 5/2011 Johansson
2013/0277387 A1 10/2013 Ulrich
2014/0116913 A1 * 5/2014 Thorburn ..... A47K 10/424 206/494

FOREIGN PATENT DOCUMENTS

CN 203419338 7/2013
EP 0938437 1/2001

* cited by examiner

DUAL-CHAMBER PACKAGE SYSTEM FOR ABSORBENT ARTICLES

CROSS REFERENCE TO RELATED APPLICATION

This application is a continuation, under 35 U.S.C. § 120, of Patent Application No. PCT/CN2017/094429, filed on Jul. 26, 2017, which is hereby incorporated by reference herein in its entirety.

FIELD

The present disclosure relates to a dual-chamber package system for absorbent articles which is capable of self-standing.

BACKGROUND

Currently, absorbent articles such as diapers and feminine pads are sold in packages. Each absorbent article is folded along its lateral axis and optionally individually wrapped, and multiple folded/wrapped absorbent particles are then stacked together and compressed into a block, which is in turn packaged and sold in stores.

In one configuration, the package containing the absorbent articles can also function as a dispenser, i.e., it contains a single chamber for housing the block of absorbent articles and at least one opening which is formed by removing a detachable piece off said package and from which the absorbent particles can be pulled out one by one by the user. The opening is typically provided on the top surface or at one of the side walls of the package/dispenser. However, the problem with this design is that as the number of absorbent articles decreases due to usage, the top-most absorbent article inside the single chamber of the package/dispenser may fall below the opening. In this event, the user will need to stick his/her fingers into the opening to reach for the topmost absorbent article.

In order to make the absorbent articles more readily accessible to the user, another configuration provides a single-chambered package/dispenser with an opening at its bottom side. In this manner, the user will always pull out the bottom-most absorbent article and will not need to reach for such article, even if there is only one absorbent article left in the package/dispenser. In this configuration, there is still a need to provide a large enough clearance area in the bottom opening to allow sufficient contact between the user's hand and the bottom-most absorbent article, because the absorbent particles are compressed together inside the chamber, and it will be difficult to pull an individual article out without sufficient contact. The requirement for such sufficiently large clearance area at the bottom side of the package/dispenser renders such package/dispenser unsuitable for direct placement on a table or a counter. Instead, it will have to be mounted onto a wall or otherwise fixated to a surface via one of its side walls or even via its top surface, so as to leave the bottom side open and clear for dispensing the absorbent articles. Such a design is therefore much less versatile in its placement and requires more time and consideration for assembling and mounting.

There is therefore a need for an improved package/dispenser which enables easy access of the absorbent articles by the user, but which also is more versatile in placement and does not require mounting to a wall or fixation to a surface.

It is also advantageous to provide an improved package/dispenser with an opening characterized by an even larger clearance area, to allow better grip of the absorbent article by the user's hand or fingers.

SUMMARY

The inventors surprisingly and unexpectedly discover that introducing dual-chamber into a package system can meet the above-described need. I.e., the dual-chamber package system can provide easy access to the absorbent articles, while no additional assembling/mounting needed.

The present disclosure relates, in part, to a dual-chamber package system for absorbent articles, comprising:

a retaining chamber configured to vertically retain a plurality of absorbent articles;

a dispensing chamber positioned underneath the retaining chamber, wherein the dispensing chamber has a front side opening; and a divider dividing the retaining chamber and the dispensing chamber, wherein at least a portion of the divider is moveable so that a bottommost absorbent article, of the plurality of absorbent articles vertically retained in the retaining chamber, is dispensable from the front side opening of the dispensing chamber.

The divider is comprised of a fixed portion, a moveable portion and a hinge line positioned therebetween, wherein the moveable portion is the at least portion of the divider that is moveable.

The present disclosure relates, in part, to an absorbent article package, comprising one or more the dual-chamber package system set forth hereabove, and absorbent articles retained in the retaining chamber of the dual-chamber package system.

An advantage of the dual-chamber package system is that the dual-chamber package system is free to stand by itself on any surface and no need to attached to a wall. Another advantage of the dual-chamber package system is that it can serve as either a primary packaging or preferably a retail packaging for storing absorbent articles for a shelf life.

Another advantage of the dual-chamber package system is capable to provide other functionalities, such as visual attraction for moms and/or babies by incorporating artworks on the package.

The present disclosure is directed, in part, to a dual-chamber package system for absorbent articles, comprising:

- a retaining chamber configured to vertically retain a plurality of absorbent articles;
- a dispensing chamber positioned underneath the retaining chamber, wherein the dispensing chamber defines a front side opening through which absorbent articles are configured to be dispensed; and
- a divider separating the retaining chamber and the dispensing chamber;

wherein the divider comprises:

- a fixed portion;
- a moveable portion;
- a hinge line positioned between the fixed portion and the moveable portion;
- a front flap on the moveable portion; and
- a tab extending from the front flap;

wherein the moveable portion is moveable between a first, non-absorbent article dispensing position to a second, absorbent article dispensing position.

The dual-chamber package system for absorbent articles may also be provided with a plurality of absorbent articles, such as diapers or feminine pads, in a kit form.

BRIEF DESCRIPTION OF THE DRAWINGS

While the specification concludes with claims particularly pointing out and distinctly claiming the subject matter which is regarded as forming the present disclosure, it is believed that the present disclosure will be better understood from the following description which is taken in conjunction with the accompanying drawings and which like designations are used to designate substantially identical elements, and in which:

DETAILED DESCRIPTION

Figure 1:
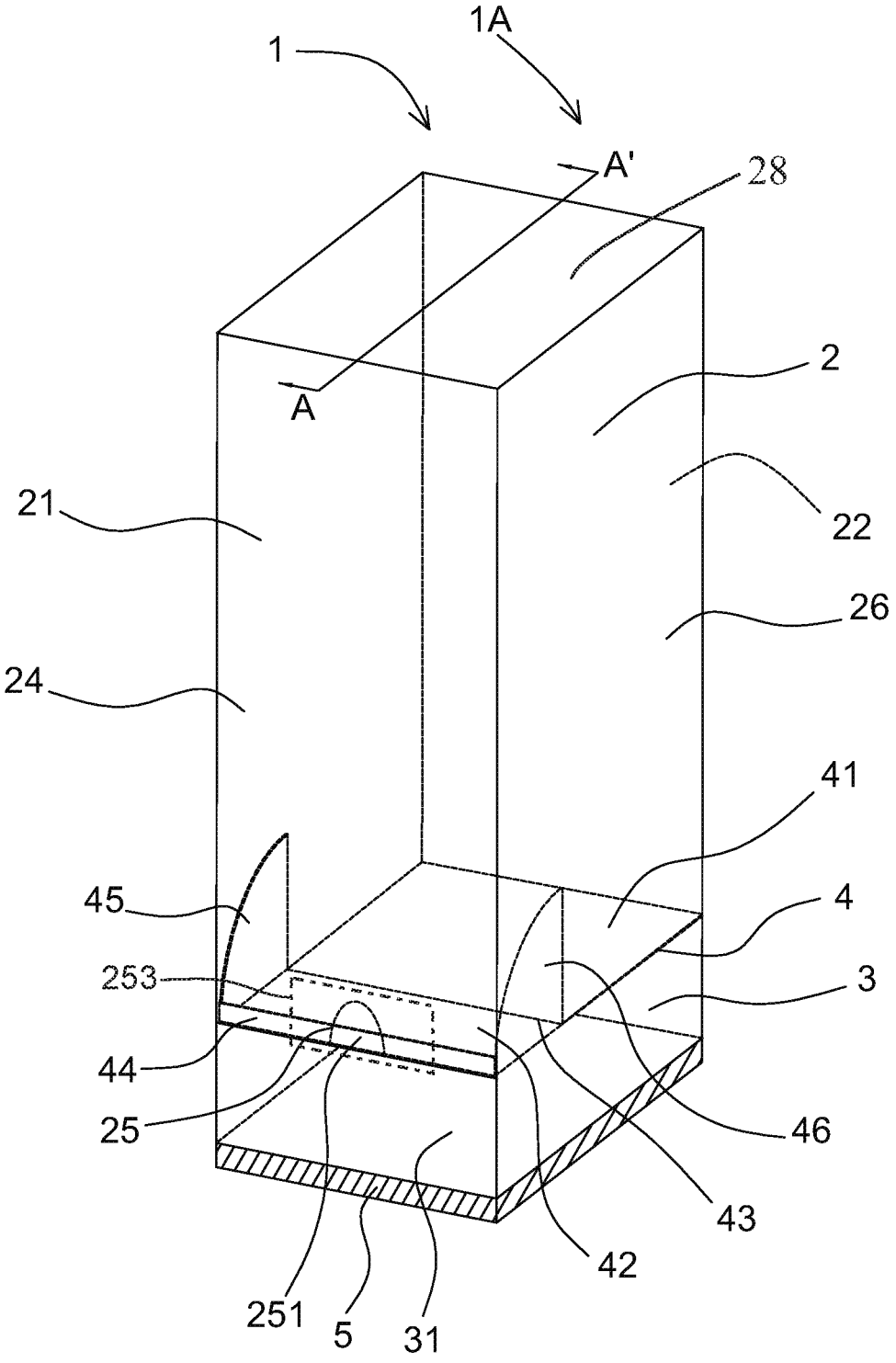
FIG. 1 is a schematic perspective view of one embodiment of a dual-chamber package system of the present disclosure in a closed configuration.

Features and benefits of the various embodiments of the present disclosure will become apparent from the following description, which includes examples of specific embodiments intended to give a broad representation of the present disclosure. Various modifications will be apparent to those skilled in the art from this description and from practice of the present disclosure. The scope of the present disclosure is not intended to be limited to the particular forms disclosed and the present disclosure covers all modifications, equivalents, and alternatives falling within the spirit and scope of the present disclosure as defined by the claims.

"Absorbent article" refers to articles of wear which may be in the form of pant-type diapers, taped diapers, swim diapers, feminine hygiene articles such as feminine pads and tampons, incontinent briefs, and the like which are so configured to also absorb and contain various exudates such as urine, feces, and menses discharged from the body.

"Longitudinal" refers to a direction running substantially perpendicular from a waist edge to an opposing waist edge of the article and generally parallel to the maximum linear dimension of the article.

"Transverse" refers to a direction perpendicular to the longitudinal direction.

"Proximal" and "distal" refer respectively to the position closer or farther relative to the longitudinal center of the article.

"Body-facing" and "garment-facing" refer respectively to the relative location of an element or a surface of an element or group of elements. "Body-facing" implies the element or surface is nearer to the wearer during wear than some other element or surface. "Garment-facing" implies the element or surface is more remote from the wearer during wear than some other element or surface (i.e., element or surface is proximate to the wearer's garments that may be worn over the disposable absorbent article).

"Disposed" refers to an element being located in a particular place or position.

"Joined" refers to configurations whereby an element is directly secured to another element by affixing the element directly to the other element and to configurations whereby an element is indirectly secured to another element by affixing the element to intermediate member(s) which in turn are affixed to the other element.

"Film" refers to a sheet-like material wherein the length and width of the material far exceed the thickness of the material. Typically, films have a thickness of about 0.5 mm or less.

"Water-permeable" and "water-impermeable" refer to the penetrability of materials in the context of the intended usage of disposable absorbent articles. Specifically, the term "water-permeable" refers to a layer or a layered structure having pores, openings, and/or interconnected void spaces that permit liquid water, urine, or synthetic urine to pass through its thickness in the absence of a forcing pressure. Conversely, the term "water-impermeable" refers to a layer or a layered structure through the thickness of which liquid water, urine, or synthetic urine cannot pass in the absence of a forcing pressure (aside from natural forces such as gravity). A layer or a layered structure that is water-impermeable according to this definition may be permeable to water vapor, i.e., may be "vapor-permeable".

"Extendibility" and "extensible" mean that the width or length of the component in a relaxed state can be extended or increased.

"Elasticated" and "elasticized" mean that a component comprises at least a portion made of elastic material.

"Elongatable material", "extensible material", or "stretchable material" are used interchangeably and refer to a material that, upon application of a biasing force, can stretch to an elongated length of at least about 110% of its relaxed, original length (i.e. can stretch to 10 percent more than its original length), without rupture or breakage, and upon release of the applied force, shows little recovery, less than about 20% of its elongation without complete rupture or breakage as measured by EDANA method 20.2-89. In the event such an elongatable material recovers at least 40% of its elongation upon release of the applied force, the elongatable material will be considered to be "elastic" or "elastomeric." For example, an elastic material that has an initial length of 100 mm can extend at least to 150 mm, and upon removal of the force retracts to a length of at least 130 mm (i.e., exhibiting a 40% recovery). In the event the material recovers less than 40% of its elongation upon release of the applied force, the elongatable material will be considered to be "substantially non-elastic" or "substantially non-elastomeric". For example, an elongatable material that has an initial length of 100 mm can extend at least to 150 mm, and upon removal of the force retracts to a length of at least 145 mm (i.e., exhibiting a 10% recovery).

"Artwork" refers to a visual presentation to the naked eye, which is provided by printing or otherwise, and having a color. Printing includes various methods and apparatus well known to those skilled in the art such as lithographic, screen printing, flexographic, and gravure ink jet printing techniques.

"Color" or "Colored" as referred to herein includes any primary color except color white, i.e., black, red, blue, violet, orange, yellow, green, and indigo as well as any declination thereof or mixture thereof. The color white is defined as those colors having an L* value of at least 94, an a* value equal to 0±2, and a b* value equal to 0±2 according to the CIE L* a* b* color system.

"Primary packaging" refers to packaging that is in direct contact with the absorbent article herein and distinguished from "retail packaging". "Retail packaging" refers to packaging that encases or encompasses the primary packaging. Retail packaging may encase one or more of the primary packaging. Any packaging that contains the primary packaging is referred to as "retail packaging", namely, a tertiary packaging that encase a secondary packaging are also collectively referred to as "retail packaging".

Relative positional terms (e.g., "bottom," "top," "side," "upper," "lower," "horizontal," "vertical," etc.) are used herein with respect to the orientation of the packaging as intended for display in retail sales or in-use environments according to artwork provided to the packaging or otherwise.

"Self-standing" refers to a state in which the packaging can maintain the intended display configuration for the length of the intended life cycle of the merchandize, typically 3 years.

As used herein, all concentrations and ratios are on a weight basis unless otherwise specified. All temperatures herein are in degrees Celsius (° C.) unless otherwise indicated. All conditions herein are at 20° C. and under the atmospheric pressure, unless otherwise specifically stated. All polymer molecular weights are by average number molecular weight unless otherwise specifically noted.

FIG. 1 shows a schematic perspective view of one embodiment of a dual-chamber package system (1) of the present disclosure in a closed configuration (1A). The dual-chamber package system (1) comprising a retaining chamber (2) and a dispensing chamber (3). The retaining chamber (2) has a front wall (21), a back wall (22), a left wall (24), a right wall (26), and a top wall (28). The retaining chamber (2) may retain a plurality of absorbent articles which are vertically packed. The dispensing chamber (3) is positioned underneath the retaining chamber (2), where the dispensing chamber (3) has a front side opening (31). The dual-chamber package system further comprises a divider (4) which divides the retaining chamber (2) and the dispensing chamber (3).

The dual-chamber package system (1) may be made by non-metal materials. The dual-chamber package system (1) may be made by reinforced pulp material typically referred to as carton or cardboard, hardened plastic such as high density polyethylene or polyethylenephthalate, or combinations thereof, which provide enough rigidity to self-stand.

Figure 2:
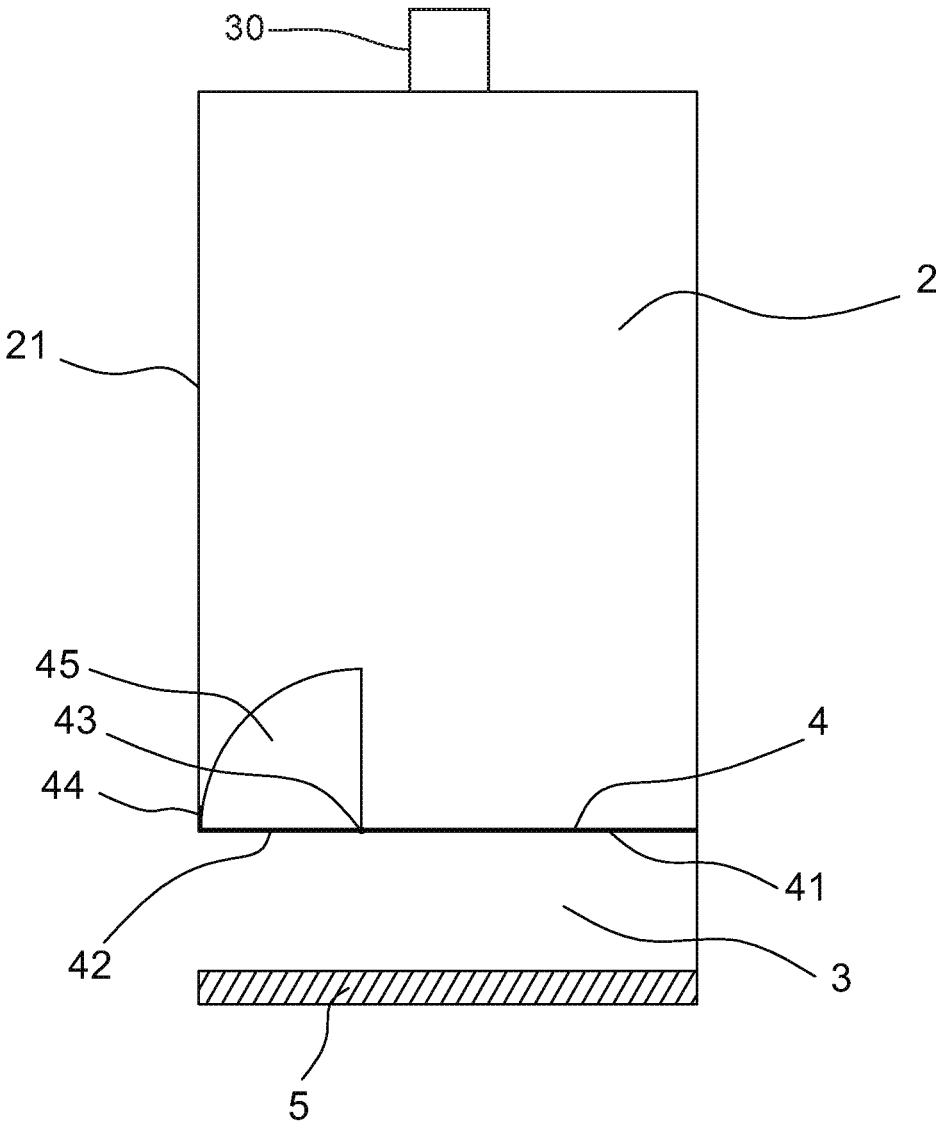
FIG. 2 is a cross-sectional view along A-A' of the dual-chamber package system of FIG. 1 in the closed configuration.

FIG. 2 shows a cross-sectional view along A-A' direction of the dual-chamber package system (1) of FIG. 1 in the closed configuration (1A).

Referring to both FIG. 1 and FIG. 2, the divider (4) comprises a fixed portion (41), a moveable portion (42) and a hinge line (43) positioned therebetween, where the moveable portion (42) is the at least portion of the divider that is operationally moveable. The fixed portion (41) has a fixed portion plane, and this fixed portion plane may be a horizontal plane. The moveable portion (42) has a moveable portion plane. The moveable portion plane of the moveable portion (42) is on the same plane as the fixed portion plane of the fixed portion (41) in a closed configuration.

Still referring to FIG. 1 and FIG. 2, the moveable portion (42) of the divider (4) may further comprise a front flap (44), and the front flap (44) may oppose the hinge line (43). Such front flap (44) extends along a plane (not shown) essentially orthogonal to the moveable portion plane of the moveable portion (42). The front flap (44) is engageable to the retaining chamber (2). In one example, the front flap (44) may be frictionally engaged with the front wall (21) of the retaining chamber (2) by inserting into the retaining chamber (2) when the moveable portion (42) is in the closed position. Alternatively, the front flap (44) may also be engaged with the front wall (21) by any other suitable means. The front flap (44) of the divider (4) may be at least partially bonded with the front wall (21) of the retaining chamber (2) by e.g. glue, or pressure, or double side adhesive tape etc.

The moveable portion (42) of the divider (4) may further comprise at least a first side flap (45) on one side of the moveable portion (42) that extends along a plane (not shown) essentially orthogonal to the moveable portion plane of the moveable portion (42). The moveable portion (42) of the divider (4) may further comprise a second side flap (46) on another side of the moveable portion (42) opposing to the first side flap (45) that extends along a plane essentially orthogonal to the moveable portion plane of the moveable portion (42). Herein the term "essentially" is a recognition that the flap may not be completely vertically, i.e., 90 degrees relative to the moveable portion plane but rather there could be some tolerances or design modifications so that the "flap" is +/−15 degrees from being vertical. Referring to FIG. 1, when the moveable portion (42) is in the closed position, the first side flap (45) is adjacent to the left wall (24) of the retaining chamber (2), while the second side flap (46) is adjacent to the right wall (26) of the retaining chamber (2). The first side flap (45) may be frictionally engaged with the left wall (24) of the retaining chamber (2), and the second side flap (46) is frictionally engaged with the right wall (26) of the retaining chamber (2). Herein the left wall (24) and the right wall (26) is referred by viewing from facing the front opening of the dispensing chamber. The intersection of the first side flap (45) and the moveable portion (42) may extend through either a part of or the whole of side length of the moveable portion (42). The shape of the first or second side flap may be of any suitable shape, e.g. a half-circle, quarter-circle, etc.

The front wall (21) of the retaining chamber (2) may comprise a line of weakness (25) at the bottom portion of the front wall (21). The line of weakness (25) may be positioned in the central part of the bottom portion of the front wall (21). The line of weakness (25) may be configured to form a thumb-shape opening (252) at the lower edge of the front wall (21). The thumb-shaped opening (252) may have a height equal to or exceeding the thickness of one piece of the absorbent article but smaller than twice the thickness thereof.

Figure 3:
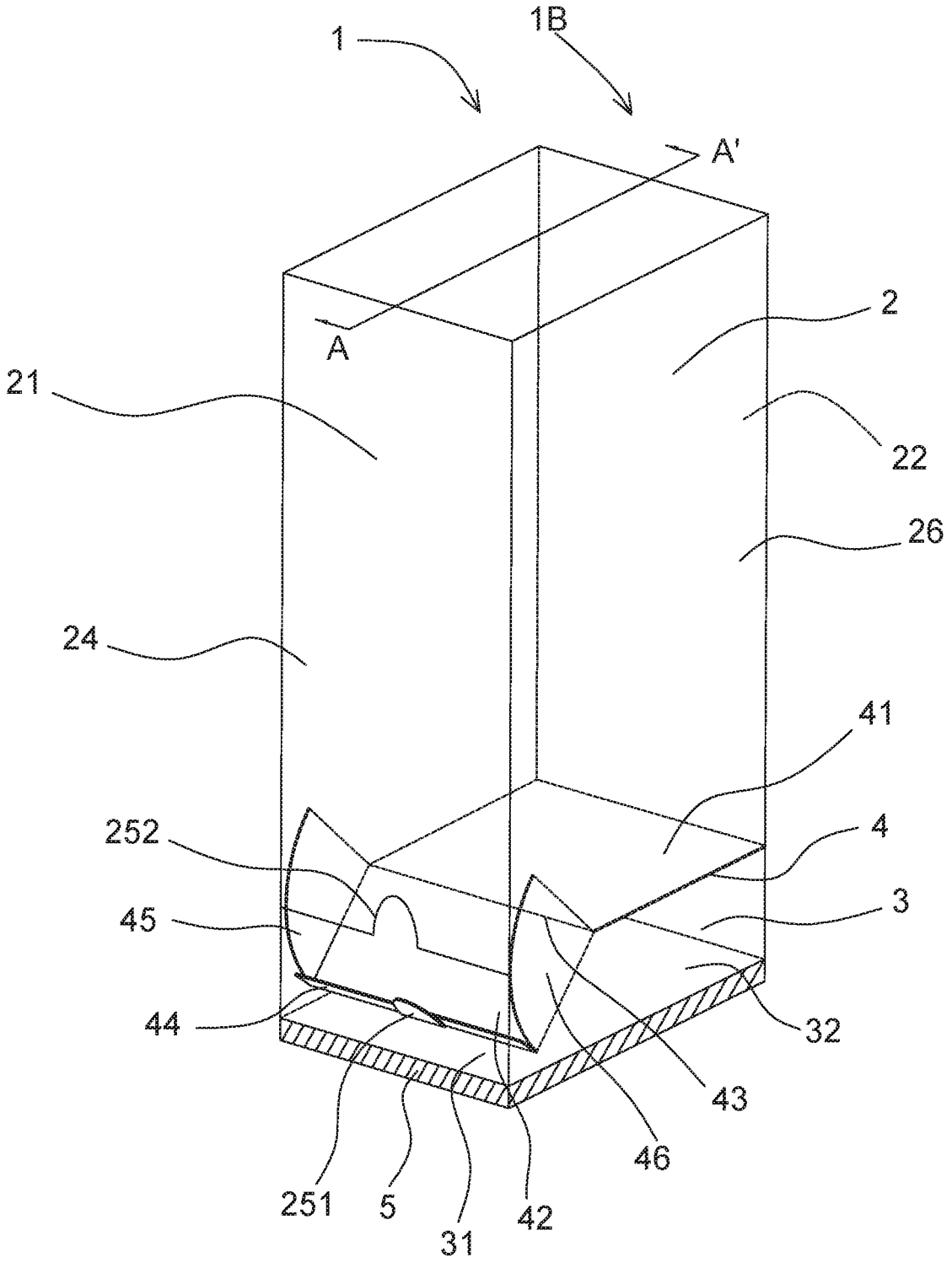
FIG. 3 is a schematic perspective view of the embodiment of the dual-chamber package system of the present disclosure in an opened configuration.

FIG. 3 shows a schematic perspective view of the embodiment of the dual-chamber package system (1) of the present disclosure in an opened configuration (1B).

The moveable portion plane of the moveable portion (42) may move downward along the hinge line (43) to reach an opened position from the closed position, at which the fixed portion plane and the moveable portion plane forms an angle (0) of less than 180 degrees, or from about 90 degrees to about 165 degrees, or from about 120 degrees to about 150 degrees.

Upon the opening action, the front flap (44) may be disengaged from the front wall (21) of the retaining chamber (2) and move downward together with the moveable portion (42) while maintaining essentially orthogonal to the moveable portion plane of the moveable portion (42). The first and second side flap (45, 46) may move downward along the hinge line (43) together with the moveable portion (42) while maintaining essentially orthogonal to the moveable portion plane of the moveable portion (42). The side flap(s)

may help protect the absorbent articles from being exposed to outside environment to avoid any potential contamination.

One approach for opening the dual-chamber package system (1) is to press and open the line of weakness (25) on the front wall (21). Upon pressing and open the line of weakness (25), a tab (251) is formed which is attached to the moveable portion (42) by structurally engaging with the front flap (44) of the divider (4) after being disconnected from the front wall (21).

The dual-chamber package system (1) may further comprise a footer (5) forming a bottom inside surface (32) of the dispensing chamber (3), which opposes the bottom surface of the fixed portion (41) of the divider (4)). The footer (5) may have a height of about 0.5 cm to about 2 cm, or from about 0.8 cm to about 1.5 cm. The height is measured between the bottom inside surface (32) of the dispensing chamber (3) and the outer bottom surface of the dual-chamber package system. The footer (5) is provided to prevent the bottommost absorbent article (100) pulled out of the retaining chamber (2) through the dispensing chamber (3) from touching the surface on which the dual-chamber package system (1) stands.

Figure 4:
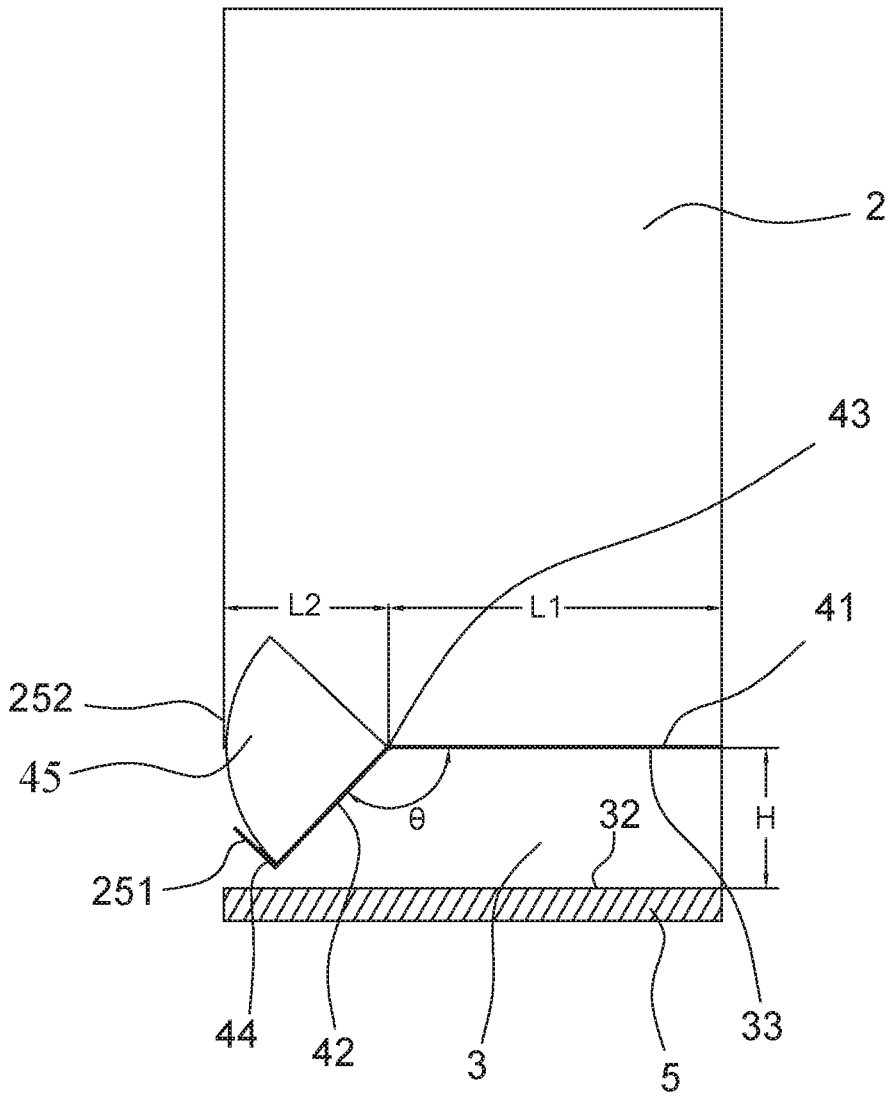
FIG. 4 is a cross-sectional view along A-A' of the dual-chamber package system of FIG. 3 in the opened configuration.

FIG. 4 shows a cross-sectional view along A-A' of the dual-chamber package system (1) of FIG. 3 in the opened configuration (1B).

The fixed portion (41) of the divider (4) has a first length (L1) which is along a direction on the moveable portion plane orthogonal to the hinge line (43), and preferably is the distance between the hinge line (43) and the back wall (22) of the retaining chamber (2). The moveable portion (42) of the divider (4) has a second length (L2) which is along a direction on the moveable portion plane orthogonal to the hinge line (43), preferably is the distance between the hinge line (43) and the front wall of the retaining chamber (2). The ratio of the second length (L2) of the moveable portion (42) to the first length (L1) of the fixed portion (41) is from about 5:1 to about 1:8, or from about 2:1 to about 1:5, or from about 1:1 to about 1:4. For example, ratio of L2:L1 could be about 1:3. If the second length (L2) is too short, the user has difficulty to put fingers to seize the bottommost absorbent article. If the second length (L2) is too long, the bottommost absorbent article may fall out of the retaining chamber (2) into the dispensing chamber (3).

The front side opening (31) of the dispensing chamber (3) has a height (H) which is the distance between the upper inside surface (32) to the bottom inside surface (33) of the dispensing chamber (3), i.e. from the bottom surface of the fixed portion (41) of the divider (4) to the top surface of the footer (5). In such case, upon opening, the moveable portion (42) of the divider (4) abuts the bottom inside surface (33) of the dispensing chamber (3) where the angle (0) between the moveable portion plane of the moveable portion (42) with the fixed portion plane of the fixed portion (41) may be from more than about 90 degrees to about 150 degrees.

Figure 5:
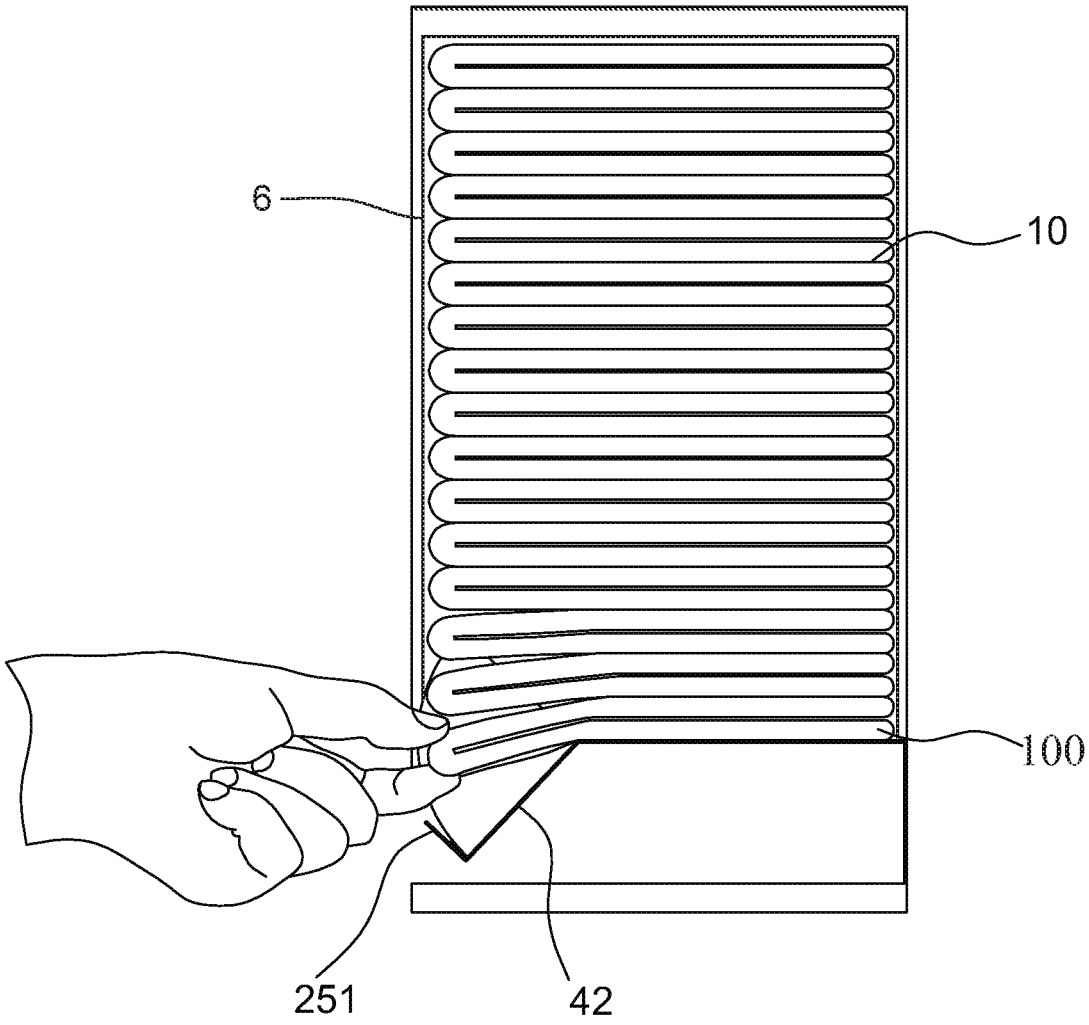
FIG. 5 is a schematic drawing illustrating the withdrawing procedure by a user.

In some embodiments as shown in FIG. 5, the absorbent articles are contained in a primary packaging (6) which is further retained in the retaining chamber (2) of the dual-chamber package system (1). That is, the retaining chamber (2) contains a primary packaging (6) housing a plurality of absorbent articles. Herein "primary packaging" refers to packaging that is in direct contact with the absorbent article. For articles such as feminine pads and tampons which may be housed in, or covered by an individual applicator/release paper/film, such applicator/release paper/film is considered part of the absorbent article.

The primary packaging (6) may be formed of a single layer or multilayer polyolefin film having a desirable combination of relatively low material cost, strength and weldability at relatively low temperatures. When a multilayer film is used, the outer and inner layers may be co-formed (such as by co-extrusion), or in another example, may be separately formed and then laminated together following their formation, by use of a suitable laminating adhesive. In this latter example, an advantage provided is that one of the layers may be printed on one side before lamination. Following that, the printed side may be faced inward (facing the other layer(s)) during lamination, such that it is protected by the other layer(s) from abrasion and wear in the finished film product, thereby preserving the integrity of the printed images, graphics, verbal content, etc. A suitable multilayer film may be formed of one or more polyolefins, such as polypropylene and polyethylene. In one example, the stock film may have at least two layers, including a first layer of polyethylene and second layer of polypropylene. In one example, a layer formed of polypropylene having a first relatively higher melting temperature, and a layer of polyethylene having a second relatively lower melting temperature, may be used to form the outer and inner layers, respectively. The absorbent articles could be diapers, or feminine hygiene articles. When the absorbent article is a diaper, a pre-determined number of diapers are folded, stacked, and compressed, prior to being enclosed in primary packaging formed of polymer film. For example, the diapers are each folded at a transverse centerline and stacked in the retaining chamber (2) with the fold line towards the front wall. For purposes of efficiency in shipment, storage, and display, a certain amount of compression is applied to the stack of diapers. The amount of compression to be applied may be determined according to the number of diaper pads to be included per package, and in consideration of the influence of the compression force applied to the diaper. The in-bag compression of the package of the present disclosure is typically in the range of from about 1000 Pa to about 10000 Pa. The primary packaging may accommodate from about 5 to about 50 articles. For sake of manufacturing efficiency, the primary packaging may be the same as those regularly supplied to the market for daily usage.

The primary packaging (6) may be provided with a line of weakness, by perforation or otherwise, for enabling the user to tear open the film for retrieving the absorbent articles from the primary packaging. In a situation where the retaining chamber (2) contains a primary packaging (6) which accommodates a plurality of absorbent articles, the line of weakness provided on the primary packaging (6) is at least partially overlapping with and preferably further structurally attached to the line of weakness (25) at the lower edge of the front wall (21) of the retaining chamber (2), so that these overlapped and structurally attached two layers of line of weaknesses can be torn open together by a user.

FIG. 5 is a schematic drawing illustrating the withdrawing procedure by a user. Folded diapers are drawn as exemplary absorbent articles (10) and the number of diapers in the figure is only for purpose of illustration. By pressing the line of weakness, a tab (251) configured by the line of weakness together with the moveable portion (42) of the divider is disconnected from the front edge of the retaining chamber, and move downwards. The thumb is introduced through the opening configured by the line of weakness and separates the bottommost diaper (100) from the second bottommost diaper. The bottommost diaper (100) is seized between thumb and the fingers, slightly tilted downwards in the seized region, and then withdrawn at an angle in forward/ downward directions through the dispensing chamber. The second bottommost diaper falls due to gravity.

As shown in FIG. 1, the dual-chamber package system (1) may further comprise an artwork (253), the information selected from the group consisting of: visual presentation, information for using the absorbent article, developmental information associated with the absorbent article, developmental information unassociated with the absorbent article, and combinations thereof. The information provided in each artwork (253) is selected according to the purpose of the package system and the types of absorbent articles to be housed in each package system. The unique artwork (253) may be one associated with the brand of the merchandize, a character, or any other attractive visual presentation. For example, the unique artwork (253) could be a drawing or figure of an animal, such as panda, elephant, cat, dolphin, or Chinese Zodiacs.

The artwork (253) may be provided at least on the front wall (21) of the retaining chamber (2). In a preferred embodiment, the line of weakness (25) on the front wall (21) of the retaining chamber (2) constitutes part of an artwork (253) on the front wall. For example, the line of weakness (25) may constitute a mouth of a panda artwork, upon tearing of the tab (251) off the front wall, the thumb-shape opening is showed as an open mouth of a smiling panda The dual-chamber package system (1) could be cuboids or block shapes, wherein the retaining chamber (2) is preferably a cuboid or block shape. In some embodiments, the dual-chamber package system (1) has a horizontal cross section of rectangular shape, having a width of from about 5 cm to about 40 cm, or from about 15 cm to about 30 cm, or from about 18 cm to about 26 cm; and a length of from about 5 cm to about 40 cm, or from about 15 cm to about 35 cm, or from about 25 cm to about 33 cm. Such dimensions are suitable for receiving e.g. once-folded diapers and ensuring the absorbent articles stacking reliably. The total height of the dual-chamber package system (1) is from about 20 cm to about 60 cm, or from about 35 cm to about 55 cm, or from about 38 cm to about 52 cm. The retaining chamber (2) may have a height from about 20 cm to about 50 cm, or from about 35 cm to about 50 cm, to receiving a certain number of vertically stacked diapers, e.g. about 5 to about 50 diapers.

The dual-chamber package system (1) may further comprise a handle (30) as shown in FIG. 2, preferably positioned at either the top wall (28) or the back wall (22) of the retaining chamber (2). Preferably, the handle (30) may be made of any suitable materials and may be made to any forms so long as it may be handled. For example, the handle (30) may be made by the same material as the dual-chamber package system. Alternatively, the handle (30) may be made by ribbons, elastic material, and otherwise. A handle (30) having ornamental features such as ribbons and elastic material may be attractive for certain purposes.

The dual-chamber package system (1) may further accommodate in the dispensing chamber (3) articles other than absorbent articles and associated with child bearing, such as wipes, clothing, bibs, toys, and otherwise.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm". Further, every numerical range given throughout this specification includes every narrower numerical range that falls within such broader numerical range.

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present disclosure have been illustrated and described, it would be obvious to those skilled in the art that various other changes and modifications can be made without departing from the spirit and scope of the present disclosure. It is therefore intended to cover in the appended claims all such changes and modifications that are within the scope of this present disclosure.

What is claimed is:

1. A dual-chamber package system for absorbent articles, comprising:

a retaining chamber configured to vertically retain a plurality of absorbent articles;

a dispensing chamber positioned underneath the retaining chamber, wherein the dispensing chamber defines a front side opening through which absorbent articles are configured to be dispensed; and a divider separating the retaining chamber and the dispensing chamber;

wherein the divider comprises:

a fixed portion;

a moveable portion;

a hinge line positioned between the fixed portion and the moveable portion;

a front flap on the moveable portion; and a tab extending from the front flap;

wherein the fixed portion has a fixed portion plane;

wherein the moveable portion has a moveable portion plane;

wherein the moveable portion plane of the moveable portion is on a same plane as the fixed portion plane of the fixed portion in a closed position;

wherein a length (L1) of the fixed portion of the divider is greater than a length (L2) of the moveable portion; and wherein the moveable portion is moveable between a first, non-absorbent article dispensing position to a second, absorbent article dispensing position.

2. The dual-chamber package system for absorbent articles according to claim 1, wherein the moveable portion plane of the moveable portion moves downward along the hinge line to reach an opened position, at which the fixed portion plane and the moveable portion plane form an angle of less than 180 degrees.

3. The dual-chamber package system for absorbent articles according to claim 1, wherein the front flap extends along a plane generally orthogonal to the moveable portion plane of the moveable portion; and wherein the front flap is engageable to the retaining chamber.

4. The dual-chamber package system for absorbent articles according to claim 1, wherein the moveable portion of the divider comprises at least a first side flap on one side of the moveable portion that extends along a plane essentially orthogonal to the moveable portion plane of the moveable portion; and wherein the moveable portion of the divider comprises a second side flap on another side of the moveable portion opposite to the first side flap that extends along a plane essentially orthogonal to the moveable portion plane of the moveable portion.

5. The dual-chamber package system for absorbent articles according to claim 1, wherein the dispensing chamber comprises a footer forming a bottom inside surface of the dispensing chamber, and wherein the footer has a height of from 0.5 cm to 2 cm.

6. The dual-chamber package system for absorbent articles according to claim 1, wherein the retaining chamber comprises a front wall, a bottom portion of the front wall comprising a line of weakness, wherein the line of weakness is configured to form the tab, wherein the tab is attached to the moveable portion by structurally engaging with the front flap of the divider after being disconnected from the front wall, and wherein the line of weakness is positioned in the central part of the bottom of the front wall.

7. The dual-chamber package system for absorbent articles according to claim 1, wherein a ratio of the length (L2) of the moveable portion to the length (L1) of the fixed portion is from 1:3 to 1:8.

8. The dual-chamber package system for absorbent articles according to claim 1, wherein the length (L2) of the moveable portion is smaller than or equal to a height (H) of the front side opening of the dispensing chamber.

9. The dual-chamber package system for absorbent articles according to claim 1, wherein the dual-chamber package system has a horizontal cross-section of rectangular shape, having a width of from 5 cm to 40 cm and a length of from 5 cm to 40 cm.

10. The dual-chamber package system for absorbent articles according to claim 6, wherein the retaining chamber comprises an artwork at least on the front wall, and wherein the line of weakness forms part of the artwork.

11. The dual-chamber package system for absorbent articles according to claim 1, comprising a handle positioned at either a top wall or a back wall of the retaining chamber.

12. The dual-chamber package system for absorbent articles according to claim 1, further comprising a primary packaging configured to accommodate the absorbent articles, wherein the absorbent articles are diapers.

13. The dual-chamber package system for absorbent articles according to claim 1, wherein the dual-chamber package system comprises a non-metal material.

14. An absorbent article package, comprising the dual-chamber package system according to claim 1, and absorbent articles retained in the retaining chamber.

15. The dual-chamber package system for absorbent articles according to claim 2, wherein the angle is from 90 degrees to 165 degrees.

16. The dual-chamber package system for absorbent articles according to claim 5, wherein the footer has a height of from 0.8 cm to 1.5 cm.

17. The dual-chamber package system for absorbent articles according to claim 9, wherein the width of the horizontal cross-section of rectangular shape is from 15 cm to 30 cm and the length of the horizontal cross-section of rectangular shape is from 15 cm to 35 cm.

18. A kit comprising the dual chamber package system for absorbent articles according to claim 1, and a plurality of diapers.

19. A kit comprising the dual chamber package system for absorbent articles according to claim 1, and a plurality of feminine pads.

* * * * *